US008688298B2

(12) United States Patent
Mizutani et al.

(10) Patent No.: US 8,688,298 B2
(45) **Date of Patent: *Apr. 1, 2014**

(54) BOAT PROPELLING SYSTEM

(75) Inventors: Makoto Mizutani, Shizuoka (JP); Ryuta Hayami, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 382 days.

This patent is subject to a terminal disclaimer.

(21) Appl. No.: 12/753,253

(22) Filed: Apr. 2, 2010

(65) Prior Publication Data

US 2010/0256845 A1 Oct. 7, 2010

(30) Foreign Application Priority Data

Apr. 3, 2009 (JP) ..... 2009-091373

(51) Int. Cl.

| | |
|---|---|
| ***B60G 17/018*** | (2006.01) |
| ***B60G 23/00*** | (2006.01) |
| ***G06F 7/00*** | (2006.01) |
| ***G06F 17/00*** | (2006.01) |
| ***A01B 69/00*** | (2006.01) |

(52) U.S. Cl.
USPC ..... 701/21; 701/41; 701/42; 440/84; 440/86; 440/53; 114/144 R; 114/144 RE

(58) Field of Classification Search
USPC ..... 701/20, 41, 42; 440/84, 86, 53; 114/144 R, 144 RE
See application file for complete search history.

(56) References Cited

U.S. PATENT DOCUMENTS 3,919,961 A * 11/1975 McDougal ..... 114/144 E
3,990,385 A * 11/1976 Adams ..... 114/144 C (Continued)

FOREIGN PATENT DOCUMENTS

JP 57-167899 A 10/1982
JP 3-5296 A 1/1991

(Continued)

OTHER PUBLICATIONS

Mizutani et al., "Boat Propelling System", U.S. Appl. No. 12/777,299, filed May 11, 2010.

(Continued)

*Primary Examiner* — Behrang Badii
*Assistant Examiner* — Daniel L Greene
(74) *Attorney, Agent, or Firm* — Keating & Bennett, LLP

(57) ABSTRACT

A boat propelling system capable of reducing electric power consumption includes an outboard engine main body, a swivel bracket arranged to allow the outboard engine main body to pivot in a right-left direction with respect to a hull, an electric motor arranged in the swivel bracket to pivot the outboard engine main body in the right-left direction, a transmission mechanism arranged in the swivel bracket to transmit a driving force of the electric motor to the outboard engine main body, a locking clutch arranged to lock the transmission mechanism so that the outboard engine main body will not be pivoted in the right-left direction by an external force acting on the outboard engine main body, a steering section arranged to steer the outboard engine main body, a steering angle sensor arranged to detect a steering angle of the steering section, a pivot sensor arranged to detect an actual pivot angle of the outboard engine main body, and an ECU arranged and programmed to control the electric motor based on a result of a comparison between a threshold value and an angle difference between a target pivot angle of the outboard engine main body based on the steering angle and an actual pivot angle. The threshold value can be set based on a boat speed and a trim angle.

9 Claims, 14 Drawing Sheets

(56) References Cited

U.S. PATENT DOCUMENTS

| | | | | |
|---|---|---|---|---|
| 4,336,594 | A * | 6/1982 | Masuzawa et al. | 701/530 |
| 5,169,348 | A * | 12/1992 | Ogiwara et al. | 440/1 |
| 5,884,213 | A * | 3/1999 | Carlson | 701/21 |
| 6,431,928 | B1 * | 8/2002 | Aarnivuo | 440/58 |
| 6,843,195 | B2 * | 1/2005 | Watabe et al. | 114/144 E |
| 7,506,599 | B2 * | 3/2009 | Mizutani | 114/144 R |
| 7,533,624 | B2 * | 5/2009 | Mizutani | 114/144 R |
| 7,540,253 | B2 * | 6/2009 | Mizutani | 114/144 RE |
| 2004/0139903 | A1 | 7/2004 | Watabe et al. | |
| 2005/0170712 | A1 * | 8/2005 | Okuyama | 440/59 |
| 2006/0166567 | A1 | 7/2006 | Otobe et al. | |
| 2011/0143608 | A1 * | 6/2011 | Chiecchi | 440/53 |

FOREIGN PATENT DOCUMENTS

| | | | |
|---|---|---|---|
| JP | 2004-217180 | A | 8/2004 |
| JP | 2004-231108 | A | 8/2004 |
| JP | 2006-199189 | A | 8/2006 |
| JP | 2007-62677 | A | 3/2007 |
| JP | 2007-331552 | A | 12/2007 |

OTHER PUBLICATIONS

Mizutani et al., "Boat Propelling System", U.S. Appl. No. 12/832,178, filed Jul. 8, 2010.

* cited by examiner

BOAT PROPELLING SYSTEM

BACKGROUND OF THE INVENTION

1. Field of the Invention

The present invention relates to boat propelling systems, and more specifically, to a boat propelling system including an electric motor arranged to pivot a propelling system main body in a right-left direction with respect to the hull.

2. Description of the Related Art

As disclosed in JP-A 2006-199189, for example, use of an electric motor to pivot an outboard engine (propelling system main body) in a right-left direction with respect to a hull for steering the hull is a conventional technique.

According to the technique in JP-A 2006-199189, a target pivot angle of a propelling system main body (e.g., outboard engine main body) which pivots with respect to the hull, is set by using a steering wheel turning angle or the like. Then, based on an angle difference between the target pivot angle and an actual pivot angle of the outboard engine, an amount of control of the electric motor is determined. The electric motor is driven in accordance with the determined amount of control and thus the outboard engine is pivoted in the right-left direction with respect to the hull.

However, according to this technique in JP-A 2006-199189, the electric motor must be continuously receiving electric power in order to maintain the outboard engine's position in the right-left direction against external forces (reaction forces) applied by the water. This leads to a problem of increased consumption of electric power.

SUMMARY OF THE INVENTION

Preferred embodiments of the present invention provide a boat propelling system that is capable of reducing electric power consumption.

According to a preferred embodiment of the present invention, a boat propelling system for propelling a hull includes a propelling system main body, a bracket section arranged to allow the propelling system main body to pivot in a right-left direction with respect to the hull, an electric motor arranged in the bracket section to pivot the propelling system main body in the right-left direction, a transmission mechanism arranged in the bracket section to transmit a driving force of the electric motor to the propelling system main body, a locking member arranged to lock the transmission mechanism so that the propelling system main body will not be pivoted in the right-left direction by an external force acting on the propelling system main body, a steering section arranged to steer the propelling system main body, a steering angle detection section arranged to detect a steering angle of the steering section, and a control section arranged and programmed to control the electric motor based on a result of a comparison between steering information regarding the steering angle and a threshold value.

In a preferred embodiment of the present invention, when the propelling system main body receives an external force, the transmission mechanism is locked by the locking member such that the propelling system main body is prevented from being pivoted in the right-left direction. This eliminates the need for a constant or continuous supply of electric power to the electric motor, and makes it possible to reduce electric power consumption. If the steering information regarding a steering angle (rotation angle) in the steering section becomes not smaller than the threshold value, the hull's direction of travel can be deviated from the desired direction of travel. Therefore, while the steering information is smaller than the threshold value, the electric motor is not driven but when the steering information is not smaller than the threshold value on the other hand, the electric motor is driven to pivot the propelling system main body in the right-left direction and thereby to bring the actual pivot angle to be equal to the target pivot angle based on the steering angle. As described, the actual pivot angle of the propelling system main body pivot angle is adjusted (pivot angle is changed) only when it is necessary to do so, whereby the boat propelling system according to the present preferred embodiment of the present invention keeps the hull travelling in a desired direction while reducing electric power consumption.

Preferably, the boat propelling system according to a preferred embodiment of the present invention further includes an actual pivot angle detection section arranged to detect an actual pivot angle of the propelling system main body, the steering information includes an angle difference between a target pivot angle based on the steering angle and the actual pivot angle, and the threshold value includes a first threshold value regarding the angle difference. With the above arrangement, the control section controls the electric motor based on a result of a comparison between the angle difference and the first threshold value. In this case, the control section obtains an angle difference between a target pivot angle based on a steering angle in the steering section and an actual pivot angle. If the angle difference between the target pivot angle and the actual pivot angle is smaller than the first threshold value, the control section does not drive the electric motor but on the other hand, if the angle difference is not smaller than the first threshold value, the control section drives the electric motor and pivots the propelling system main body in the right-left direction. By utilizing the angle difference, a determination of the necessity/unnecessity for adjustment of the actual pivot angle can be made easily and accurately as described above.

Further preferably, the steering information includes a steering angle change amount in the steering section, and the threshold value includes a second threshold value regarding the steering angle change amount. With the above-described arrangement, the control section controls the electric motor based on a result of comparison between the steering angle change amount and the second threshold value. In this case, the control section obtains an amount of change in a steering angle in the steering section, and if the steering angle change amount is smaller than the second threshold value, the control section does not drive the electric motor. On the other hand, if the change amount is not smaller than the second threshold value, the control section drives the electric motor and pivots the propelling system main body in the right-left direction. As described, an easy and accurate determination of the necessity/unnecessity for adjustment of the actual pivot angle is possible based only on the steering angle change amount in the steering section.

Further, preferably, the steering information includes a rotation speed average value of the steering section, and the threshold value includes a third threshold value regarding the rotation speed average value. With the above-described arrangement, the control section controls the electric motor based on a result of comparison between the rotation speed average value and the third threshold value. In this case, the control section obtains a rotation speed average value in the steering section, and if the rotation speed average value is smaller than the third threshold value, the control section does not drive the electric motor. On the other hand, if the average value is not smaller than the third threshold value, the control section drives the electric motor and pivots the propelling system main body in the right-left direction. As described above, an easy and accurate determination of the necessity/unnecessity for adjustment of the actual pivot angle is possible based only on the rotation speed average value in the steering section.

Preferably, the boat propelling system further includes an actual pivot angle detection section arranged to detect an actual pivot angle of the propelling system main body, the steering information includes a steering angle change amount in the steering section, and the threshold value includes the second threshold value regarding the steering angle change amount and a fourth threshold value regarding an actual pivot angle change amount. With the above-described arrangement, the control section controls the electric motor based on a result of comparison between the steering angle change amount and the second threshold value as well as based on a result of comparison between the actual pivot angle change amount and the fourth threshold value. In this case, the control section obtains a steering angle change amount in the steering section and an actual pivot angle change amount, and if the steering angle change amount is smaller than the second threshold value or if the actual pivot angle change amount is smaller than the fourth threshold value, the control section does not drive the electric motor. In the other cases, the control section drives the electric motor and pivots the propelling system main body in the right-left direction. As described, by taking not only the steering angle change amount but also the actual pivot angle change amount into account, it becomes possible to determine the necessity/unnecessity for adjustment of the actual pivot angle more easily and accurately. This provides an advantage particularly in situations where there is a time lag between an operation made at the steering section and a subsequent change in the pivot angle.

Further preferably, the boat propelling system further includes a speed detection section arranged to detect a boat speed which is a speed of the hull, and a setting section arranged to set the threshold value based on the boat speed. Further, preferably, the setting section sets a smaller value to the threshold value when the boat speed becomes higher. A higher boat speed results in a greater behavior change of the boat as a response to the actual pivot angle, which means that even a small value of the steering information such as an angle difference between a target pivot angle and an actual pivot angle will result in a large deviation of the hull's direction of travel from the desired direction. By setting a smaller value to the threshold value when the boat speed becomes higher, it becomes possible to prevent the hull's direction of travel from experiencing excessive deviation from the target, and therefore to keep the hull travelling in the desired direction.

Preferably, the bracket section further allows the propelling system main body to pivot in an up-down direction with respect to the hull, and the boat propelling system preferably further includes a trim angle detection section arranged to detect a trim angle of the propelling system main body. With this arrangement, the setting section sets the threshold value based on the boat speed and the trim angle. Behavior of the boat as expressed in yaw rate, roll, lateral acceleration, etc., changes in accordance with the trim angle. For example, a boat may have a shape with a characteristic that causes the yaw rate to increase with a decrease in the trim angle (i.e., the boat turns well even if the pivot angle is small) whereas there are boats which have a characteristic that a greater trim angle will cause greater side skidding, smaller rolling and greater lateral acceleration. By taking not only the boat speed but also the trim angle into account, the shape of the boat is also taken into account in setting the threshold value, which leads to even better steering of the hull.

The above-described and other features, elements, characteristics, steps, aspects and advantages of the present invention will become clearer from the following detailed description of preferred embodiments of the present invention with reference to the attached drawings.

DETAILED DESCRIPTION OF THE PREFERRED EMBODIMENTS

Hereinafter, preferred embodiments of the present invention will be described with reference to the drawings.

The description will cover a case where a boat propelling system 10 according to a preferred embodiment of the present invention is installed in a boat 1. A symbol "FWD" which appears in some of the drawings indicates a forward travelling direction of the boat 1.

Figure 2:
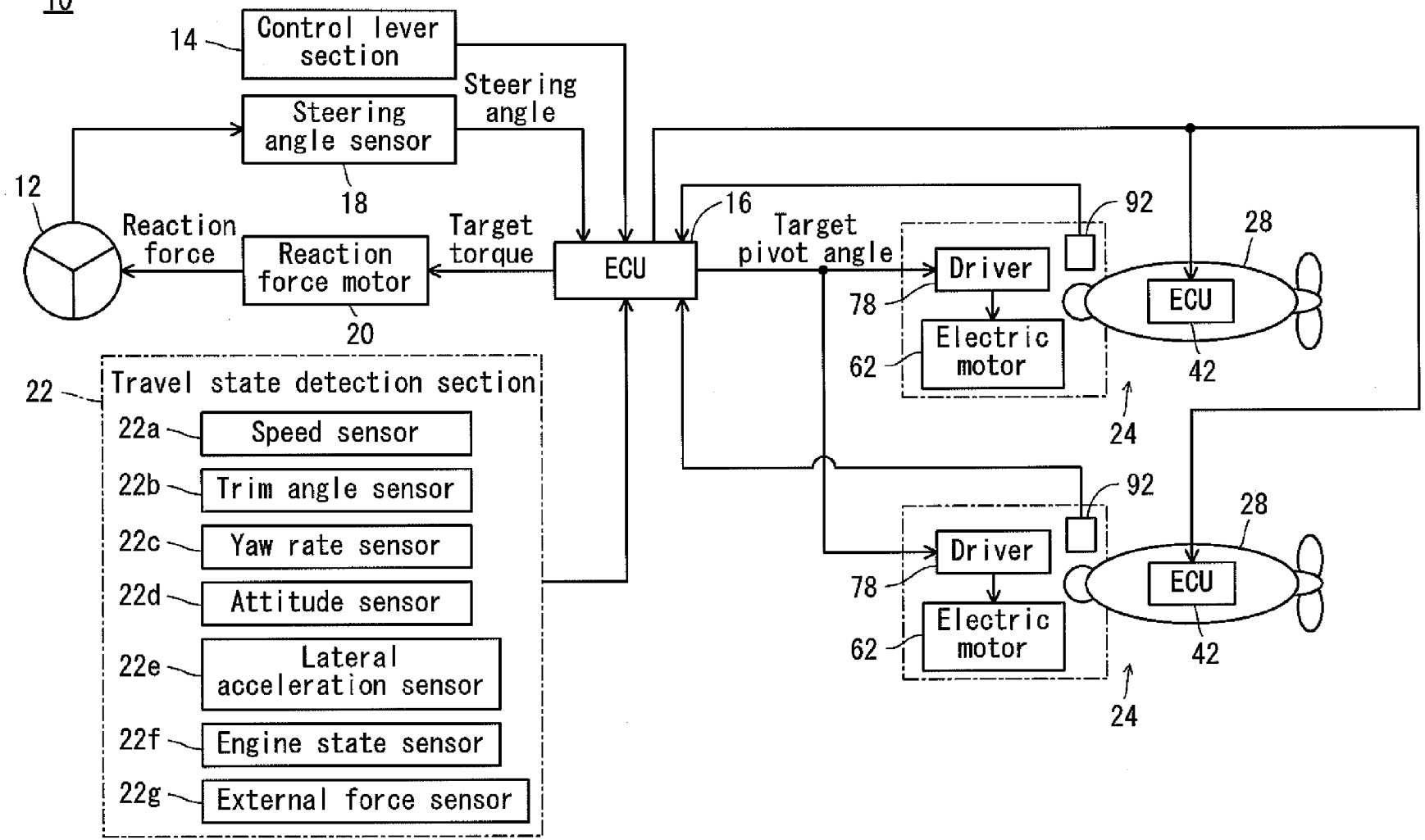
FIG. 2 is a block diagram showing a configuration of the boat propelling system in FIG. 1.

Referring also to FIG. 2, the boat 1 includes a hull 2 and a boat propelling system 10 installed on the hull 2.

The boat propelling system 10 includes a steering section 12 arranged inside the hull 2 to steer outboard engine main bodies 28 (to be described later); a control lever section 14 arranged near the steering section 12 to perform a forward-moving or rearward-moving operation of the hull 2; an ECU (Electronic Control Unit) 16 arranged and programmed to control operations of the boat propelling system 10; a steering angle sensor 18 arranged to detect a steering angle (rotation angle) of a rotating operation of the steering section 12; a reaction force motor 20 which is connected to the steering section 12 to provide the steering section 12 with a reaction force; a travel state detection section 22 arranged to detect a state of travel of the boat 1; and a plurality (e.g., two or more) of outboard engines 24 mounted on a transom board 3 of the hull 2 in order to propel the boat 1. The travel state detection section 22 preferably includes a speed sensor 22*a*, a trim angle sensor 22*b*, a yaw rate sensor 22*c*, an attitude sensor 22*d*, a lateral acceleration sensor 22*e*, an engine state sensor 22*f*, and an external force sensor 22*g*. The speed sensor 22*a* detects a boat speed by using a GPS, for example. The trim angle sensor 22*b* detects a trim angle of the outboard engine main bodies 28 by detecting an amount of stroke of trim cylinders, for example. The yaw rate sensor 22*c* detects a state of turning of the boat 1. The attitude sensor 22*d* detects an attitude of the boat 1 indicated by a roll angle, a pitch angle or the like, by using a gyroscope, for example. The lateral acceleration sensor 22*e* detects a centrifugal force working on the boat 1 during a turn. The engine state sensor 22*f* detects a throttle opening degree and the number of revolutions of the engine. The external force sensor 22*g* detects an external force applied to the outboard engine main bodies 28, preferably via load sensors, for example, provided in the outboard engine main bodies 28. These elements may preferably be electrically interconnected, mainly by a LAN cable 26.

Next, the outboard engines 24 will be described.

The outboard engines 24 do not have rudders but provide steering as the outboard engines 24 are moved like a rudder.

Figure 3:
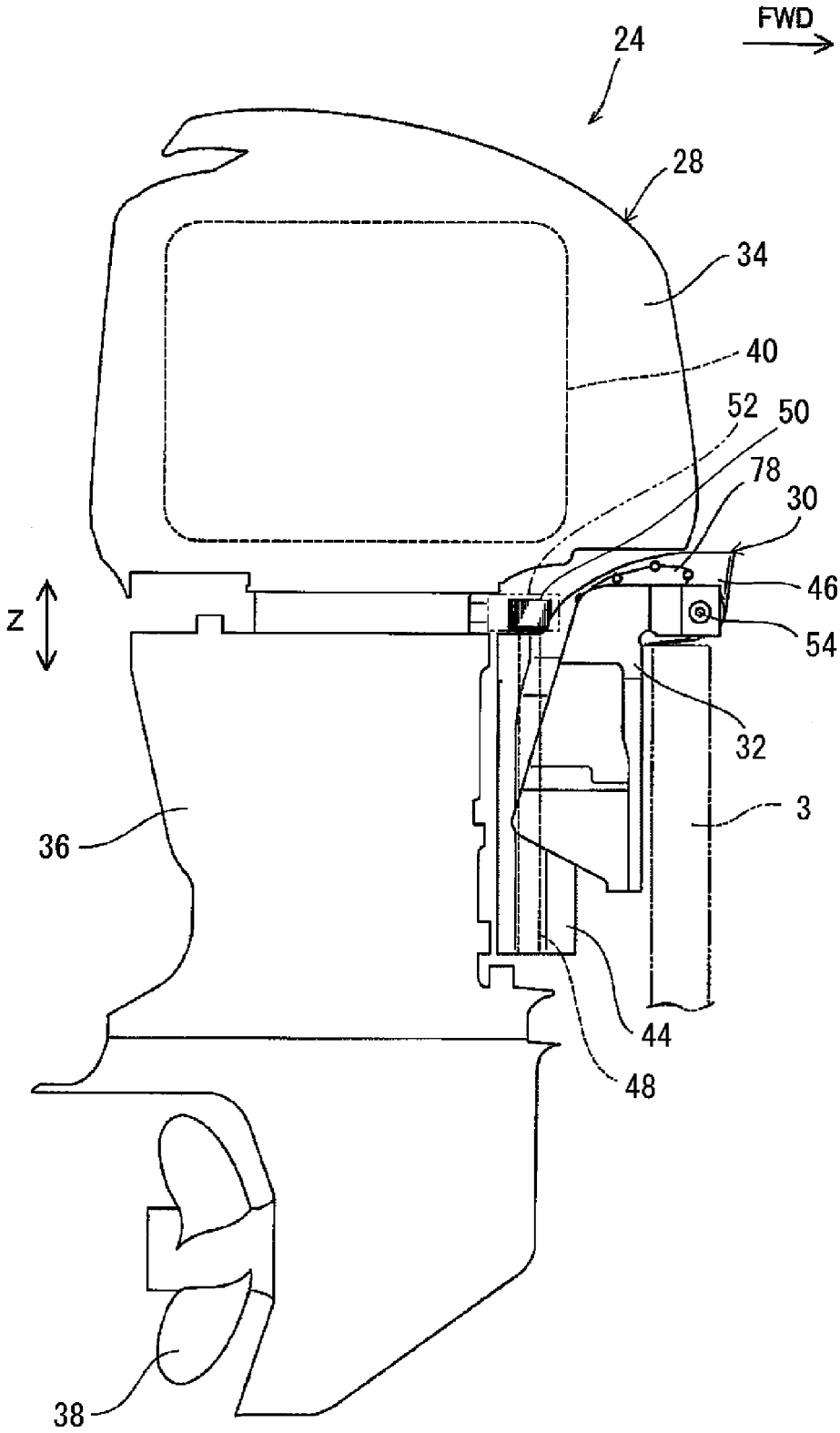
FIG. 3 is a side view showing an overall configuration of an outboard engine in FIG. 1.

Referring to FIG. 3, each outboard engine 24 includes an outboard engine main body 28, a swivel bracket 30 and tilt brackets 32.

The outboard engine main body 28 includes, from top to down, a cowling section 34, a case section 36 and a propeller 38. In the outboard engine 24, the outboard engine main body 28 is pivoted in the right-left direction to change the direction of the propeller 38. The hull 2 changes its direction as it receives propelling force from the propellers 38.

Figure 1:
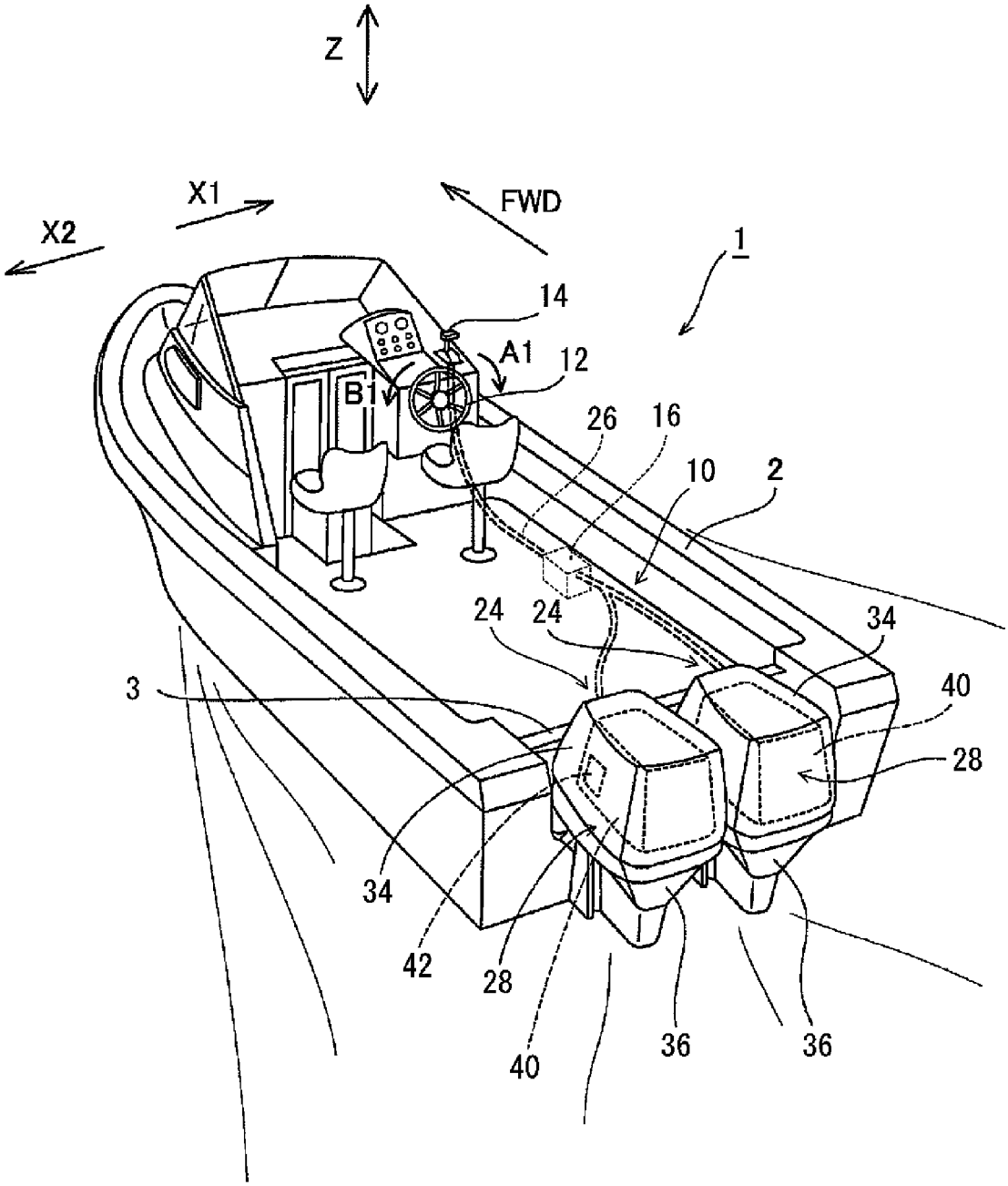
FIG. 1 is a perspective view showing an example of a boat which is equipped with a boat propelling system according to a preferred embodiment of the present invention.

The cowling section 34 houses such components as an engine 40 and the ECU 42 (see FIG. 1) which is electrically connected with the engine 40.

The swivel bracket 30 includes a bracket lower portion 44 and a bracket upper portion 46.

The bracket lower portion 44 is a hollow tube provided in an up-down direction (Direction Z) of the outboard engine main body 28. Into the bracket lower portion 44, a swivel shaft 48 is pivotably inserted, so the swivel shaft 48 is held to extend in the up-down direction (Direction Z) of the outboard engine main body 28. The swivel shaft 48 includes an upper end 50, which is connected with the outboard engine main body 28 via a connection fitting 52. Thus, the outboard engine main body 28 is mounted to the swivel bracket 30 pivotably around the swivel shaft 48, i.e., pivotably in the right-left direction (indicated by Arrow X1 and Arrow X2 in FIG. 1) relative to the hull 2.

The swivel bracket 30 is sandwiched between a pair of tilt brackets 32. The tilt brackets 32 are fixed to the transom board 3 on the rear side of the hull 2. The swivel bracket 30 and the tilt brackets 32 are penetrated by a tilt shaft 54. The tilt shaft 54 extends perpendicularly or substantially perpendicularly to the swivel shaft 48, in a widthwise direction (indicated by Arrow X1 and Arrow X2 in FIG. 1) of the hull 2. Thus, the swivel bracket 30, i.e., the outboard engine main body 28 is pivotable around the tilt shaft 54, in the up-down direction (Direction Z) relatively to the hull 2. In other words, the outboard engine main body 28 is pivotable around the tilt shaft 54 by a tilt cylinder (not illustrated), and is pivoted up to a near horizontal position when the boat comes ashore, for example. The outboard engine main body 28 is also pivotable around the tilt shaft 54 by a trim cylinder (not illustrated). Thus, the trim angle of the outboard engine main body 28 is adjustable, so that an up-down propelling direction of the propellers 38 is adjusted within a given vertical plane, during navigation.

Figure 4:
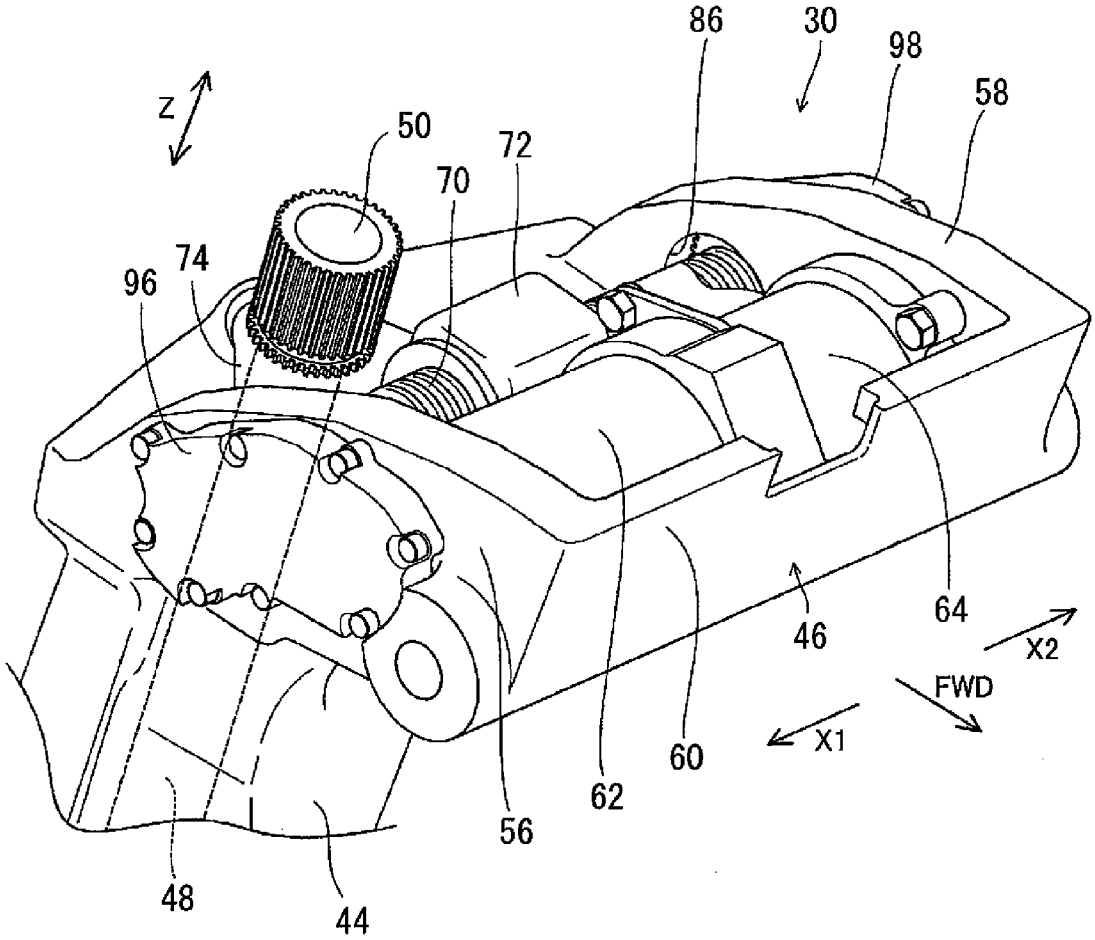
FIG. 4 is a perspective view for describing a configuration of a swivel bracket of the outboard engine in FIG. 1.
Figure 5:
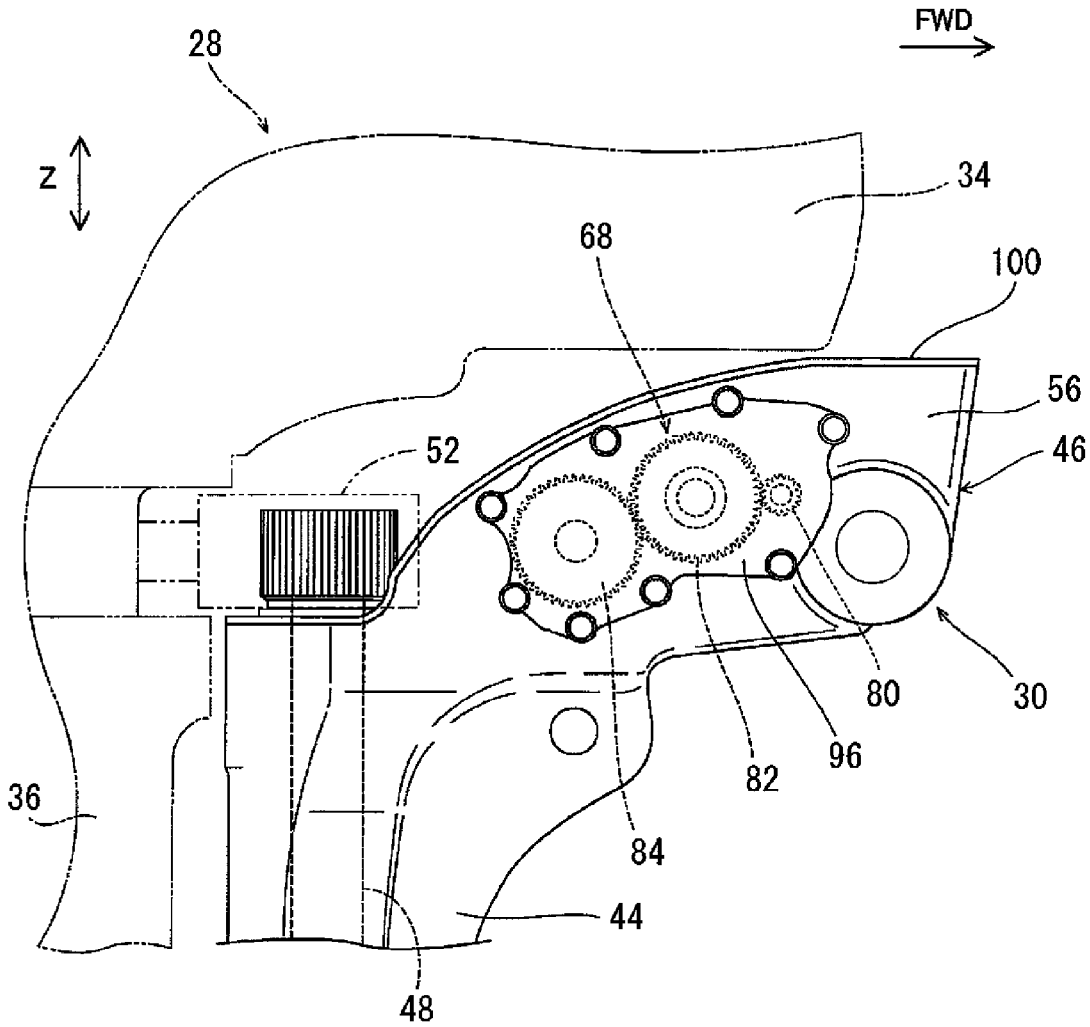
FIG. 5 is a side view for describing the configuration of the swivel bracket of the outboard engine in FIG. 1.
Figure 6:
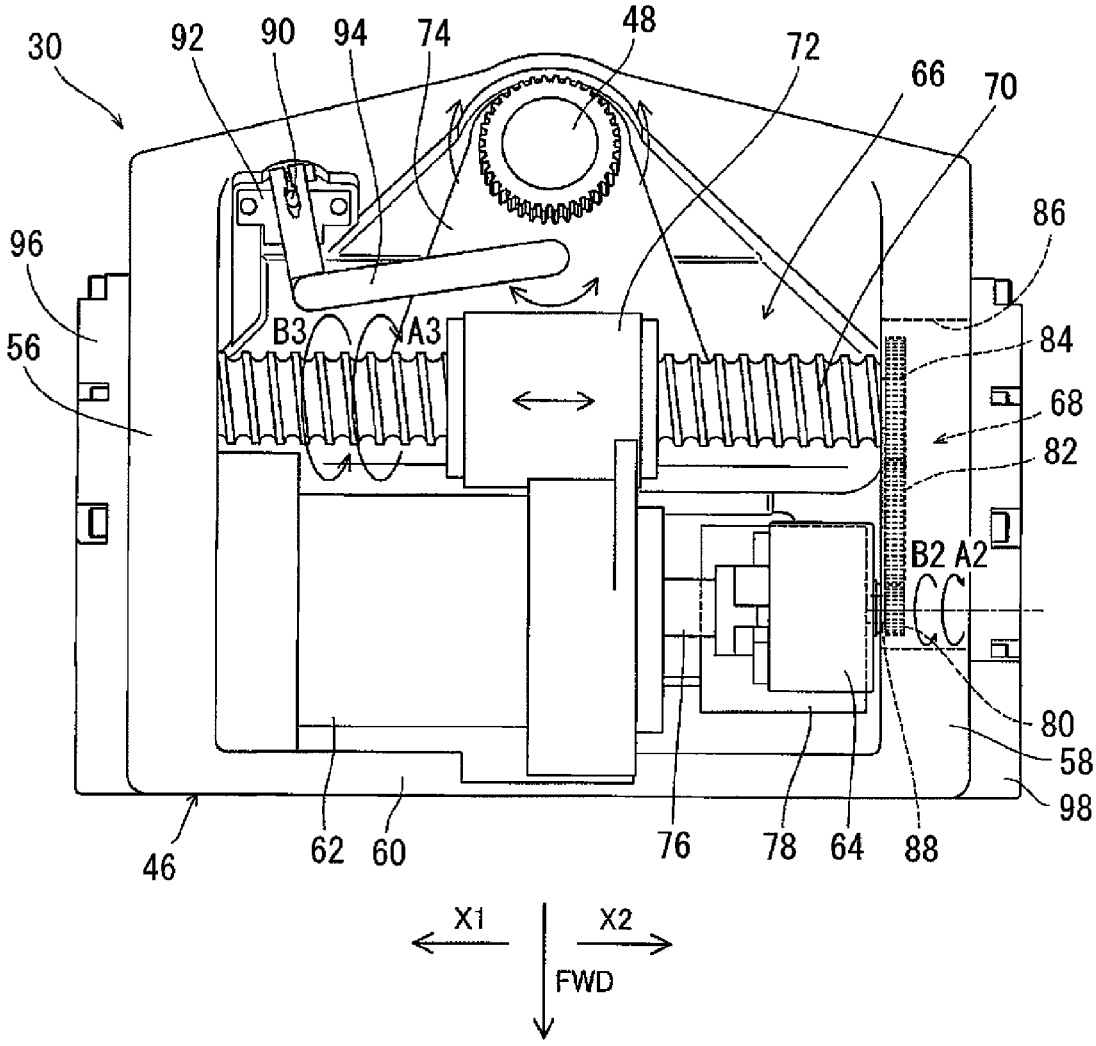
FIG. 6 is a plan view for describing the configuration of the swivel bracket of the outboard engine in FIG. 1.

Next, reference will also be made to FIG. 4 through FIG. 6 to describe the swivel bracket 30 in detail.

The bracket upper portion 46 is at an upper end of the bracket lower portion 44, protruding in the forward direction (Direction indicated by Arrow FWD). The bracket upper portion 46 preferably has a substantially upward opening box configuration, and includes a pair of two side wall portions 56, 58 each having an increasing height toward the front as viewed from a side; and a front wall portion 60 which connects these two side wall portions 56, 58 at their front ends. The upper end 50 of the swivel shaft 48 which is inserted into the bracket lower portion 44 protrudes in the bracket upper portion 46.

The bracket upper portion 46 houses an electric motor 62, a locking clutch 64 and most of a transmission mechanism 66.

The transmission mechanism 66, which transmits the driving force of the electric motor 62 to the outboard engine main body 28, includes a gear section 68; a ball screw 70 connected with the gear section 68; a ball nut 72 engaged with the ball screw 70 movably on the ball screw 70; a transmission plate 74 which connects the ball nut 72 with the swivel shaft 48; the swivel shaft 48; and the connection fitting 52.

The electric motor 62 is provided inside the swivel bracket 30, near the front wall portion 60 closer to the side wall portion 56, with its motor shaft 76 extending in the widthwise direction of the hull 2 (indicated by Arrow X1 and Arrow X2). The electric motor 62 provides power to pivot the outboard engine main body 28. The electric motor 62 is electrically connected with a driver 78. When the user performs a steering operation in the steering section 12, the driver 78 receives operation signals via the LAN cable 26 and controls the operation of electric motor 62 based on the signals. Specifically, when the steering section 12 is being rotated in the clockwise direction (Arrow A1 direction: see FIG. 1), the driver 78 controls the electric motor 62 so that the motor shaft 76 will rotate in Arrow A2 direction. On the other hand, when the steering section 12 is being rotated in the counterclockwise direction (Arrow B1 direction: see FIG. 1), the driver 78 controls the electric motor 62 so that the motor shaft 76 will rotate in Arrow B2 direction.

The locking clutch 64 is disposed coaxially with the motor shaft 76 of the electric motor 62, connects the motor shaft 76 with the gear section 68 and transmits the driving force from the electric motor 62 toward the swivel shaft 48, i.e., toward the outboard engine main body 28. However, the locking clutch 64 also has a locking capability of not transmitting an external force (reaction force) from the outboard engine main body 28 to the electric motor 62 thereby preventing the outboard engine main body 28 from being pivoted in the right-left direction by the external force. The locking clutch 64 is a reverse input shutoff clutch which is provided by, e.g., a product called "Torque Diode" (Registered Trademark) manufactured by NTN Corporation. Thus, as the motor shaft 76 rotates, rotation of the motor shaft 76 is transmitted to the locking clutch 64 and to the gear section 68 connected therewith. On the other hand, when the outboard engine main body 28 receives a pivoting force in the right-left direction during navigation, for example, and even if the gear section 68 receives a rotational force, the gear section 68 will not rotate since the locking clutch 64 will lock and prevent the gear section 68 from rotating. In other words, during navigation, even if reaction forces applied by the water or other forces act in the right-left direction with respect to the outboard engine main body 28, the locking clutch 64 works and there is no need for driving the electric motor 62 in order to maintain the pivot angle. The locking clutch 64 of such a simple configuration eliminates the need for keeping the electric motor 62 always in drive.

The gear section 68 serves as reduction gears and as shown in FIG. 5 and FIG. 6, preferably is provided at an opening 86 in the side wall portion 58, and preferably includes three flat gears 80, 82 and 84. The flat gear 80, which is engaged with a shaft member 88 protruding from a downstream side (the side closer to the side wall portion 58) of the locking clutch 64, rotates with the shaft member 88. The flat gear 82 is engaged with the flat gear 80 and also with the flat gear 84. In other words, the flat gear 82 serves as a middle gear which transmits the rotation of the flat gear 80 to the flat gear 84. The flat gear 84 is engaged with the ball screw 70 and is rotated integrally with the ball screw 70.

As the ball screw 70 rotates, the ball nut 72 moves axially of the ball screw 70 (in direction indicated by Arrow X1 and Arrow X2). Specifically, as the motor shaft 76 rotates in Arrow A2 direction, the gear section 68 rotates the ball screw 70 in Arrow A3 direction, and the ball nut 72 moves toward the side wall portion 58 (in Arrow X2 direction). On the other hand, as the motor shaft 76 rotates in Arrow B2 direction, the gear section 68 rotates the ball screw 70 in Arrow B3 direction, and the ball nut 72 moves toward the side wall portion 56 (in Arrow X1 direction).

The transmission plate 74 is connected with the ball nut 72 and also engaged with the swivel shaft 48. Thus, the transmission plate 74 can pivot around the swivel shaft 48 as the ball nut 72 moves in Arrow X1 direction or Arrow X2 direction, allowing the swivel shaft 48 to rotate to pivot the outboard engine main body 28. As the ball nut 72 moves toward the side wall portion 58 (in Arrow X2 direction), the outboard engine main body 28 is steered in Arrow X1 direction while it is steered in Arrow X2 direction as the ball nut 72 moves toward the side wall portion 56 (in Arrow X1 direction).

Near the transmission plate 74 and closely to the side wall portion 56, a pivot sensor 92 is provided to detect a pivoting angle of its pivot shaft 90. The pivot sensor 92 is connected with the transmission plate 74 via a link member 94. The link member 94 is moved by a pivotal movement of the transmission plate 74 around the swivel shaft 48, and as the link member 94 moves, the pivot shaft 90 of the pivot sensor 92 pivots. The pivot sensor 92 detects the pivoting angle of the pivot shaft 90, based on which the ECU 16 calculates a pivoting angle of the transmission plate 74, i.e., an actual pivot angle of the outboard engine main body 28.

With the above described arrangement, a plate member 96 is attached to the side wall portion 56 of the bracket upper portion 46 whereas a plate member 98 is attached to the side wall portion 58 to cover the opening 86. Also, a cover member 100 is attached as shown in FIG. 5, on the upper surface of the bracket upper portion 46 so as to cover the entire upper opening, thereby sealing the inside space of the bracket upper portion 46.

Returning to FIG. 2, in the boat propelling system 10 as described so far, the ECU 16 includes a CPU and a memory. The memory stores programs for performing operations shown in FIG. 7, FIG. 8, and FIG. 10 through FIG. 13; maps which contain information shown in FIG. 9A and FIG. 9B; and others.

The ECU 16 receives a signal which indicates the steering angle of the steering section 12, from the steering angle sensor 18; a control signal from the control lever section 14; a signal which indicates the pivot angle, from the pivot sensor 92; and sensor signals from the sensors in the travel state detection section 22.

The ECU 16 calculates a target torque in accordance with a given steering angle and a state of external force, and gives the calculated target torque to the reaction force motor 20. The reaction force motor 20 outputs a reaction force torque in accordance with the given target torque to the steering section 12. This provides various operation feelings from heavy to light as he/she operates the steering section 12.

Also, the ECU 16 sends a signal, which indicates a target pivot angle given by the user as he/she rotates the steering section 12, to the driver 78 inside the swivel bracket 30. The ECU 16 thereby controls steering of the outboard engine main body 28. Further, the ECU 16 sends a signal which represents the user's operation of the control lever section 14 to the ECU 42 inside the outboard engine main body 28, thereby controlling the output of the engine 40. The propeller 38 rotates as the engine 40 rotates.

In the present preferred embodiment, the outboard engine main body 28 is an example of a propelling system main body, and the locking clutch 64 is an example of a locking member. The bracket section includes the swivel bracket 30 and the tilt brackets 32. The steering angle detection section includes the steering angle sensor 18; the actual pivot angle detection section includes the pivot sensor 92 and the ECU 16; the speed detection section includes the speed sensor 22*a*; and the trim angle detection section includes the trim angle sensor 22*b*. Also, the ECU 16 functions as the control section and the setting section.

Now, examples of operation of the boat 1 which is equipped with the boat propelling system 10 as the above will be described with reference to FIG. 7 through FIG. 13.

Figure 7:
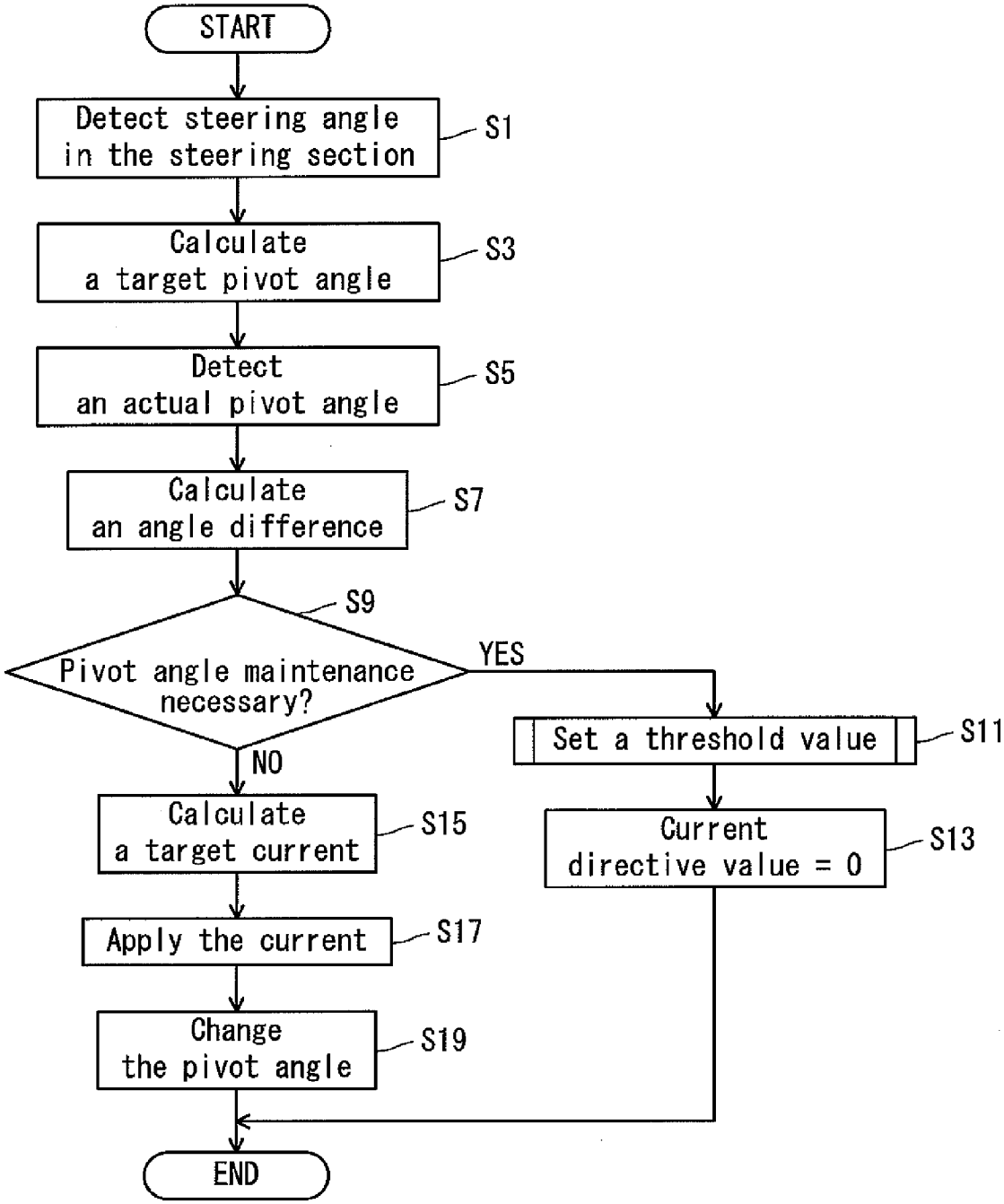
FIG. 7 is a flowchart showing an example of operation regarding pivot angle maintenance according to a preferred embodiment of the present invention.

Reference will be made to FIG. 7, to describe operations regarding steering.

First, the steering angle sensor 18 detects a steering angle (rotation angle) of the steering section 12 (Step S1). Based on the steering angle, the ECU 16 calculates a target pivot angle (Step S3). Then, the pivot sensor 92 detects a pivoting angle of the pivot shaft 90, and based on the pivoting angle, the ECU 16 detects an actual pivot angle of the outboard engine main body 28 (Step S5). The ECU 16 calculates an angle difference between the calculated target pivot angle and the actual pivot angle of the outboard engine main body 28 (Step S7), and determines whether or not pivot angle maintenance is necessary by a procedure to be described later (Step S9). If pivot angle maintenance is necessary, a procedure to be described later is followed to set a threshold value for use in determining necessity/unnecessity for pivot angle maintenance (Step S11). Then, the ECU 16 prevents the electric motor 62 from driving by setting an electric current directive value to zero (Step S13) and brings the process to an end.

On the other hand, if Step S9 determines that pivot angle maintenance is not necessary, the ECU 16 calculates a target current based on the angle difference between the target pivot angle and the actual pivot angle (Step S15), and applies the current to the electric motor 62 based on the target current (Step S17). The power from the electric motor 62 is transmitted to the outboard engine main body 28 via the transmission mechanism 66, to pivot the outboard engine main body 28 (Step S19), and the process comes to an end. The operation shown in FIG. 7 is repeated in a time interval of approximately 5 milliseconds, for example.

Figure 8:
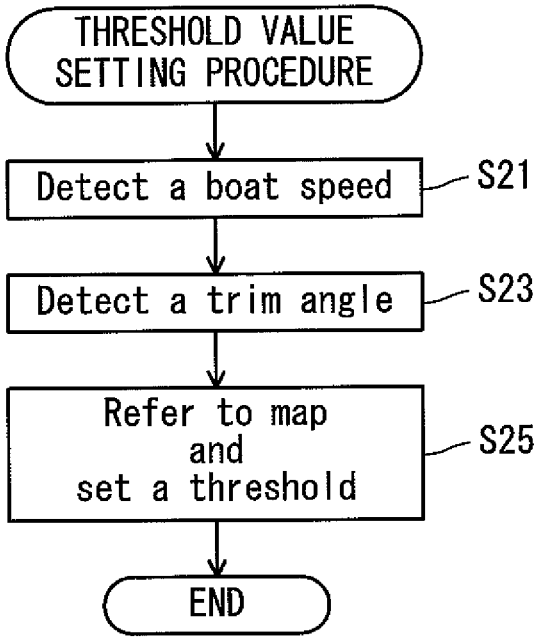
FIG. 8 is a flowchart showing an example of threshold value setting procedure in Step S11 in FIG. 7.

Next, reference will be made to FIG. 8 to describe an example of the threshold value setting procedure in Step S11 in FIG. 7.

Figure 9A:
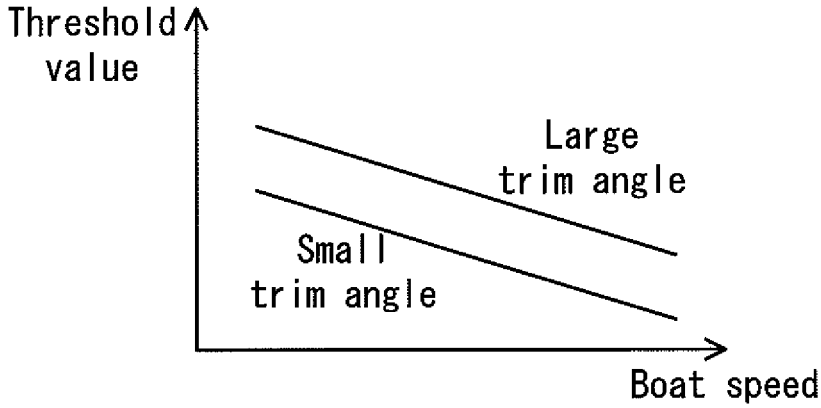
FIGS. 9A and 9B shows graphs indicating relationships between boat speed, trim angle and threshold values.
Figure 9B:
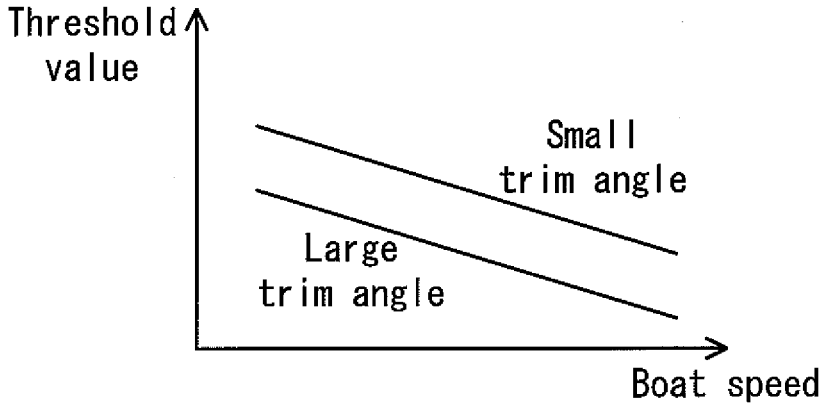

First, the speed sensor 22*a* detects a boat speed (Step S21), and the trim angle sensor 22*b* detects a trim angle (Step S23). Then, the ECU 16 refers to a map, for example, which contains information as exemplified in FIG. 9; and sets a threshold value based on the detected boat speed and trim angle (Step S25); and then proceeds to Step S13. In cases where the boat characteristic is that the yaw rate increases with decrease in the trim angle (i.e., the boat turns well even if the pivot angle is small), a map as shown in FIG. 9A is utilized. FIG. 9A shows a case in which, with the trim angle being constant, the greater the boat speed, the smaller the threshold value; and with the boat speed being constant, the greater the trim angle, the greater the threshold value. On the other hand, in cases where the boat characteristic is that a greater trim angle will cause greater side skidding, smaller rolling and greater lateral acceleration, a map as shown in FIG. 9B is utilized. FIG. 9B shows a case where, with the trim angle being constant, the greater the boat speed, the smaller the threshold value; and with the boat speed being constant, the greater the trim angle, the smaller the threshold value.

The threshold value is set in accordance with a comparison variable in Step S9 in FIG. 7.

In cases where the comparison variable is provided by an angle difference between the target pivot angle based on the steering angle in the steering section 12 and the actual pivot angle (see FIG. 10), the threshold value is provided by a first threshold value. In this case, the first threshold value is preferably within a value range of not smaller than about 0.1° and not greater than about 1°, for example.

In cases where the comparison variable is provided by a steering angle change amount in the steering section 12 (see FIG. 11 and FIG. 13), the threshold value is provided by a second threshold value. In this case, the second threshold value is preferably within a value range of not smaller than about 10° and not greater than about 50°, for example.

In cases where the comparison variable is provided by a rotation speed average value in the steering section 12 (see FIG. 12), the threshold value is provided by a third threshold value. In this case, the third threshold value is preferably within a value range of not smaller than about 10°/sec and not greater than about 50°/sec, for example.

In cases where the comparison variable is provided by the actual pivot angle change amount (see FIG. 13), the threshold value is provided by a fourth threshold value. In this case, the fourth threshold value is preferably within a value range of not smaller than about 0.1° and not greater than about 0.5°, for example.

Figure 10:
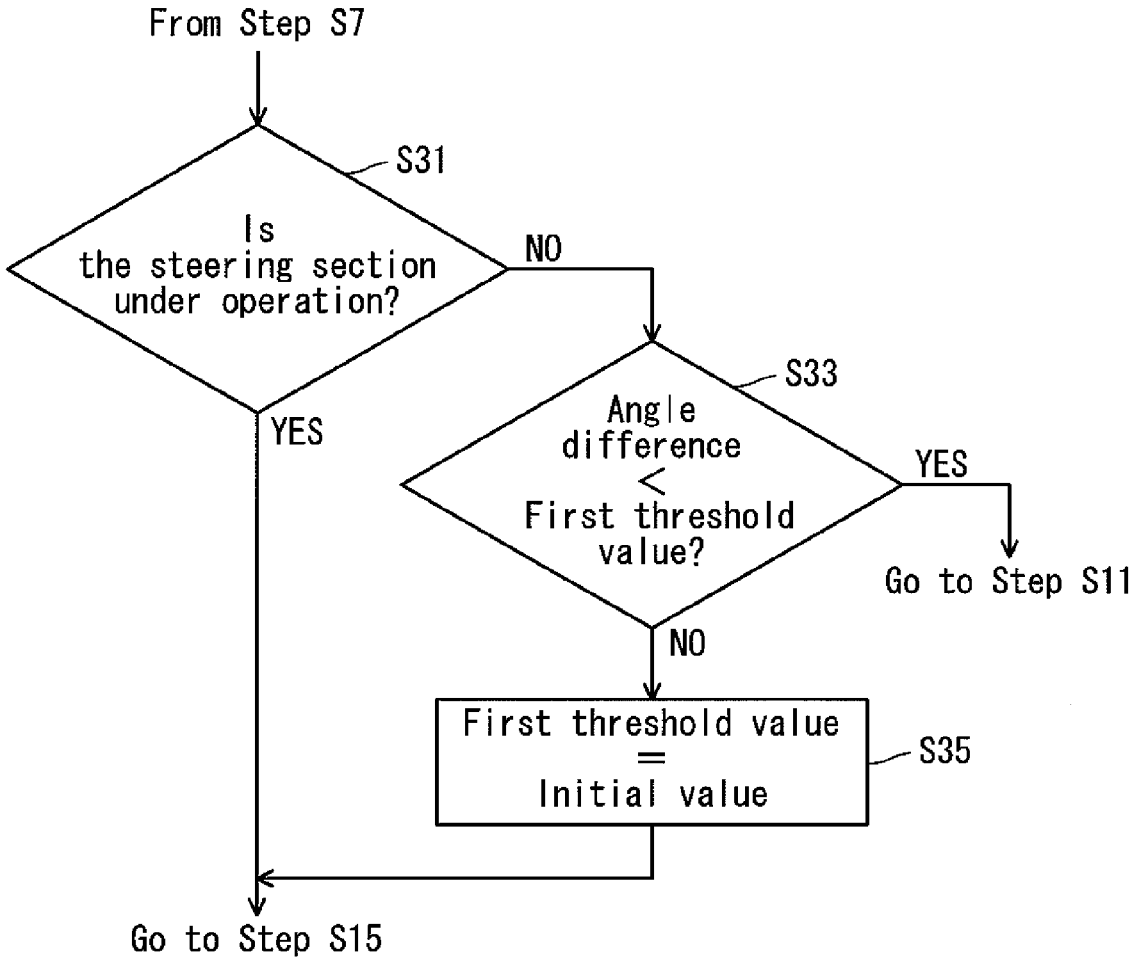
FIG. 10 is a flowchart showing an example of pivot angle maintenance necessity determination procedure in Step S9 in FIG. 7.

Next, reference will be made to FIG. 10 to describe an example of the pivot angle maintenance necessity/unnecessity determination procedure in Step S9 in FIG. 7.

First, the ECU 16 determines whether or not the steering section 12 is being operated (Step S31) preferably based on an output from the steering angle sensor 18, for example. If the steering section 12 is not being operated, the ECU 16 determines whether or not an angle difference between the target pivot angle and the actual pivot angle is smaller than the first threshold value which was set in Step S11 in FIG. 7 (Step S33). If the angle difference is smaller than the first threshold value, it is determined that pivot angle maintenance is necessary and the process goes to Step S11. On the other hand, if the angle difference is not smaller than the first threshold value, it is determined that pivot angle maintenance is not necessary, and the first threshold value is reset to an initial value (Step S35), and the process goes to Step S15. The initial value is provided by a minimum value of the first threshold value for example. On the other hand, if Step S31 determines that the steering section 12 is being operated, it is determined that pivot angle maintenance is not necessary and the process goes to Step S15.

According to the boat propelling system 10 as described above, the locking clutch 64 locks the transmission mechanism 66 when the outboard engine main body 28 receives an external force, whereby the outboard engine main body 28 is prevented from being pivoted in the right-left direction. This eliminates the need for supplying electric power constantly to the electric motor 62, making it possible to reduce electric power consumption. Also, since the gear section 68 in the transmission mechanism 66 attenuates the received external force, i.e., the reverse-driving torque, which acts on the outboard engine main body 28, the locking clutch 64 may be of a small torque capacity. In other words a small locking clutch 64 may be utilized.

According to this arrangement, if the angle difference between the target pivot angle and the actual pivot angle is smaller than the first threshold value, the electric motor 62 is not driven whereas if the angle difference becomes not smaller than the first threshold value, the electric motor 62 is driven to pivot the outboard engine main body 28 in the right-left direction until the actual pivot angle becomes equal to the target pivot angle. As described, the actual pivot angle is adjusted (the pivot angle is changed) only when it is necessary to do so, whereby the arrangement keeps the hull 2 travelling in a desired direction while reducing electric power consumption. Also, by utilizing the angle difference, the arrangement provides an easy and accurate determination of the necessity/unnecessity for adjustment of the actual pivot angle.

The threshold value is set to a smaller value when the boat speed is higher. This prevents the hull 2 from deviating excessively from the intended direction of travel. Further, by taking not only the boat speed but also the trim angle into account, the shape of the boat 1 is also taken into account in setting the threshold value, which leads to even better steering of the hull 2.

Figure 11:
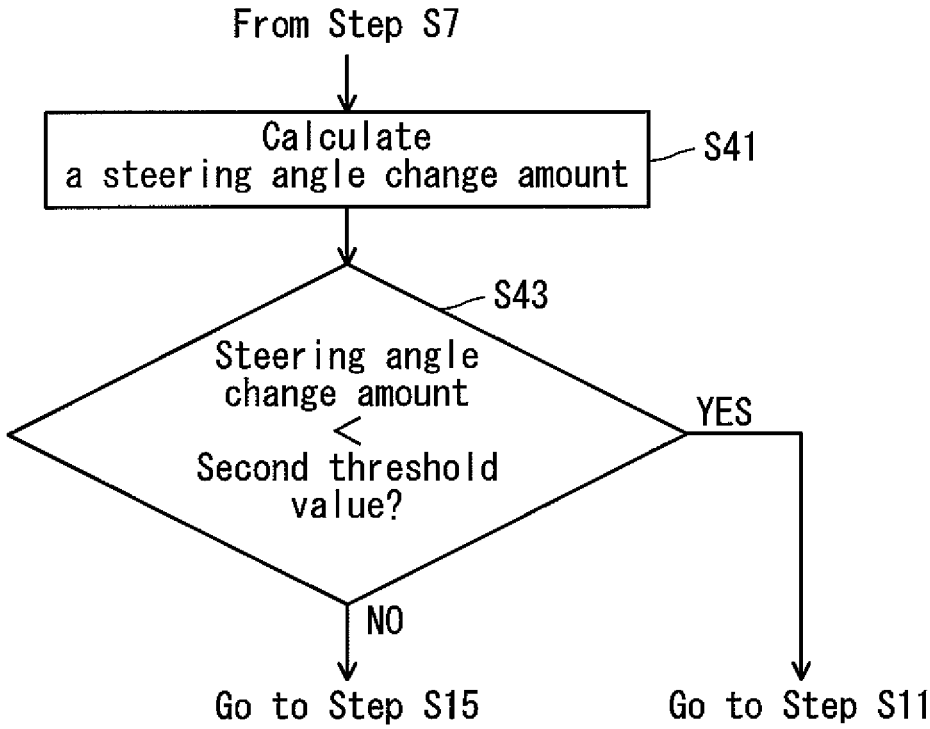
FIG. 11 is a flowchart showing another example of the pivot angle maintenance necessity determination procedure in Step S9 in FIG. 7.

Next, reference will be made to FIG. 11, to describe another example of the pivot angle maintenance necessity/unnecessity determination procedure in Step S9 in FIG. 7.

First, the ECU 16 calculates an amount of change in the steering angle in the steering section 12 based on the output from the steering angle sensor 18 (Step S41). The steering angle change amount is calculated as a difference between the previous steering angle and the current steering angle. Then, the ECU 16 determines whether or not the steering angle change amount is smaller than the second threshold value which was set in Step S11 in FIG. 7 (Step S43). If the steering angle change amount is smaller than the second threshold value, it is determined that pivot angle maintenance is necessary and the process goes to Step S11. On the other hand, if the steering angle change amount is not smaller than the second threshold value, it is determined that pivot angle maintenance is not necessary, and the process goes to Step S15.

In this case, an easy and accurate determination of the necessity/unnecessity for adjustment of the actual pivot angle is possible only from the steering angle change amount in the steering section 12.

Figure 12:
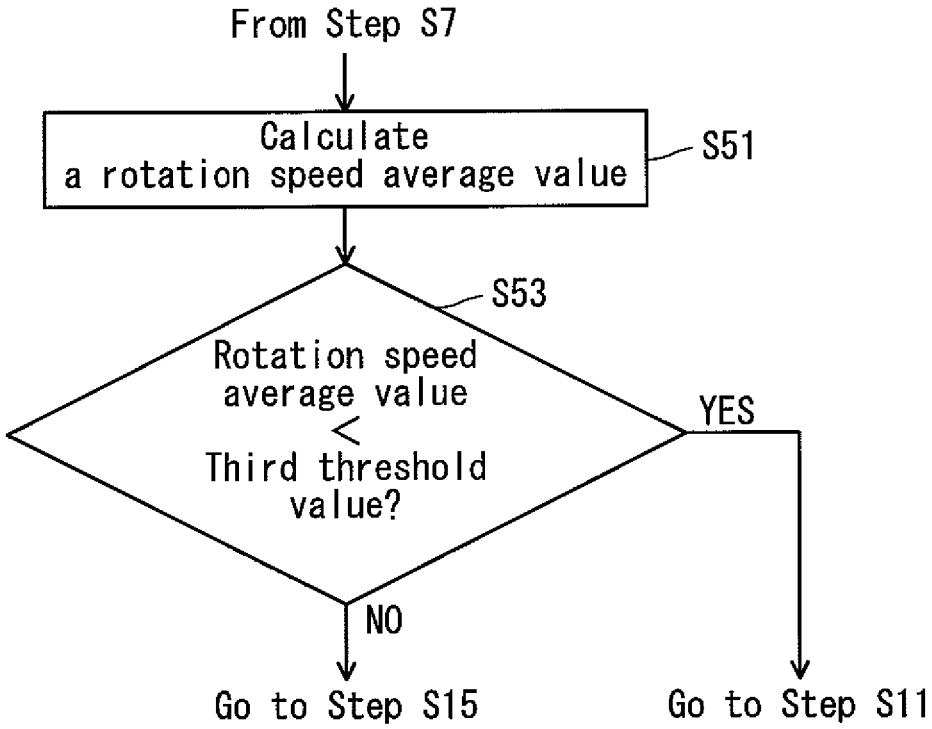
FIG. 12 is a flowchart showing still another example of the pivot angle maintenance necessity determination procedure in Step S9 in FIG. 7.

Further, reference will be made to FIG. 12 to describe still another example of the pivot angle maintenance necessity determination procedure in Step S9 in FIG. 7.

First, the ECU 16 calculates a rotation speed average value in the steering section 12 (Step S51). In this process, the ECU 16 calculates a rotation speed for each of several time durations in the steering section 12 based on the output from the steering angle sensor 18, and averages these rotation speeds to obtain the rotation speed average value. Then, the ECU 16 determines whether or not the rotation speed average value is smaller than the third threshold value which was set in Step S11 in FIG. 7 (Step S53). If the rotation speed average value is smaller than the third threshold value, it is determined that pivot angle maintenance is necessary and the process goes to Step S11. On the other hand, if the rotation speed average value is not smaller than the third threshold value, it is determined that pivot angle maintenance is not necessary and the process goes to Step S15.

In this case, an easy and accurate determination is possible only from the rotation speed average value in the steering section 12, on the necessity/unnecessity for adjustment of the actual pivot angle.

Figure 13:
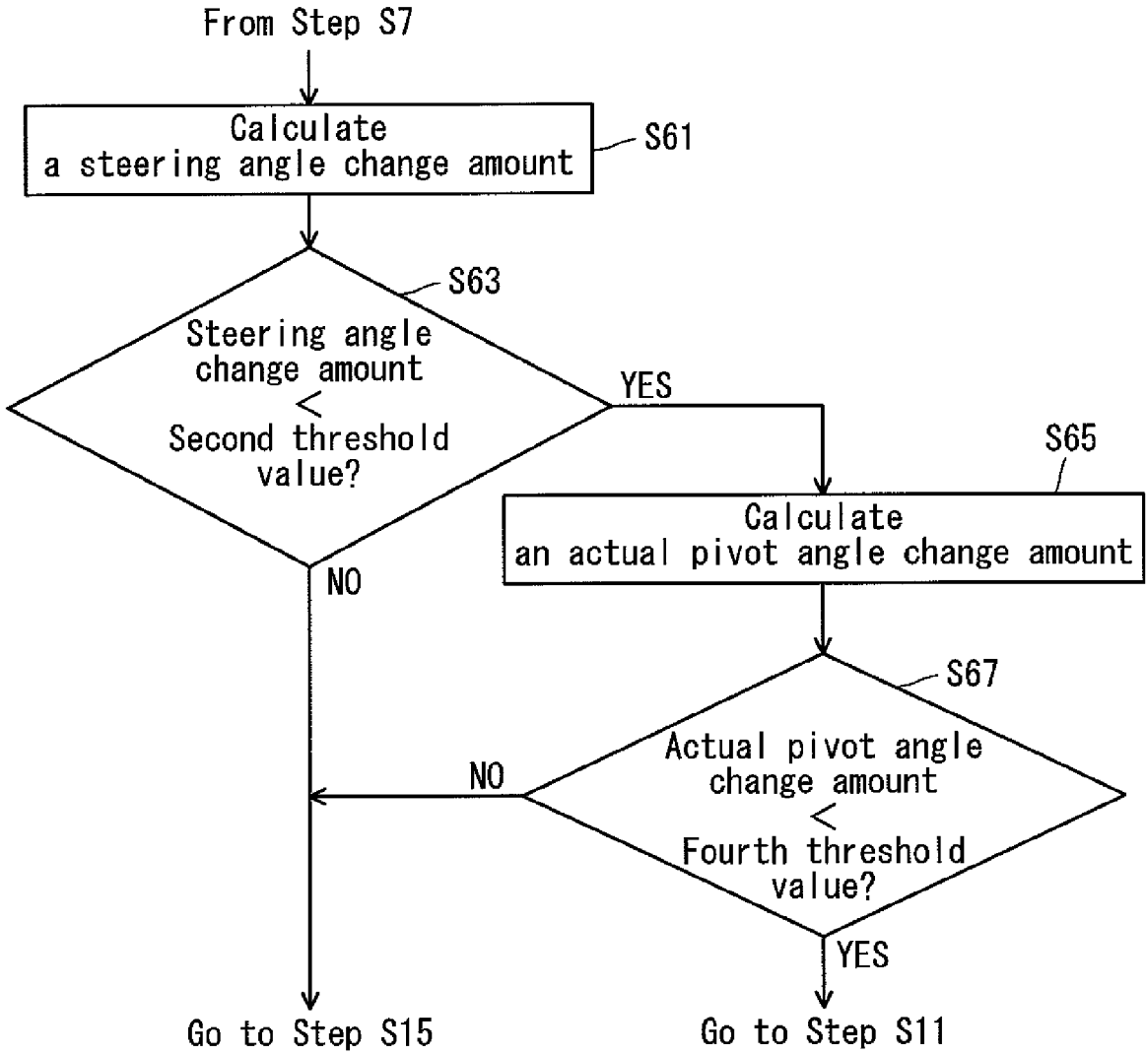
FIG. 13 is a flowchart showing still another example of the pivot angle maintenance necessity determination procedure in Step S9 in FIG. 7.

Reference will be made to FIG. 13 to describe still another example of the pivot angle maintenance necessity determination procedure in Step S9 in FIG. 7.

First, the ECU 16 calculates an amount of change in the steering angle in the steering section 12 based on the output from the steering angle sensor 18 (Step S61). The steering angle change amount is calculated as a difference between the previous steering angle and the current steering angle. Then, the ECU 16 determines whether or not the steering angle change amount is smaller than the second threshold value which was set in Step S11 in FIG. 7 (Step S63). If the steering angle change amount is smaller than the second threshold value, the process goes to Step S65. In Step S65, the ECU 16 calculates an amount of change in the actual pivot angle in the outboard engine main body 28 based on the output from the pivot sensor 92. The actual pivot angle change amount is calculated as a difference between the previous actual pivot angle and the current actual pivot angle. Then, the ECU 16 determines whether or not the actual pivot angle change amount is smaller than the fourth threshold value which was set in Step S11 in FIG. 7 (Step S67). If the actual pivot angle change amount is smaller than the fourth threshold value, it is determined that pivot angle maintenance is necessary and the process goes to Step S11. On the other hand, if the actual pivot angle change amount is not smaller than the fourth threshold value, it is determined that pivot angle maintenance is not necessary, and the process goes to Step S15.

Also, if Step S63 determines that the steering angle change amount is not smaller than the second threshold value, it is determined that pivot angle maintenance is unnecessary and the process goes to Step S15.

As described, by taking not only the steering angle change amount but also the actual pivot angle change amount into account, it becomes possible to determine the necessity/unnecessity for adjustment of the actual pivot angle more easily and accurately. This provides an advantage particularly in such an instance as a high-load situation where there is a time lag between an operation made on the steering section 12 and a subsequent change in the pivot angle.

It should be noted here that in the operation shown in FIG. 13, the steering angle change amount may be replaced by the rotation speed average value in the steering section 12. Also, the actual pivot angle change amount may be replaced by an angle difference between the target pivot angle and the actual pivot angle, an amount of change in the angle difference, an amount of change in the yaw rate or an amount of driving current, etc.

The threshold value (the first threshold value through the fourth threshold value) which is set in Step 11 in FIG. 7 may be set solely on the basis of the boat speed. Also, the threshold value may be set on the basis of at least one of the following variables, i.e., the number of revolutions of the engine 40; the actual pivot angle of the outboard engine main body 28; the number of the outboard engines 24; an attitude of the boat 1; the yaw rate; and the length, the weight, etc., of the boat 1. In any of these cases, it is possible to set a threshold value by making reference to a map which gives a relationship between the variable and the threshold value.

Figure 14A:
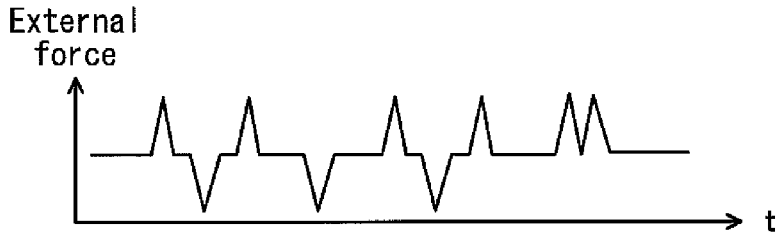
FIGS. 14A-14E include graphs showing an example of comparison in terms of electric power consumption between a boat propelling system according to a preferred embodiment of the present invention and a conventional system.
Figure 14B:
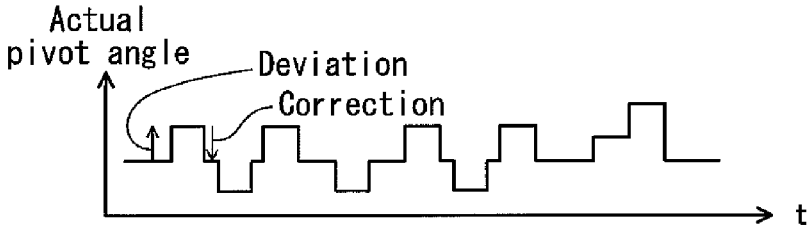
Figure 14C:
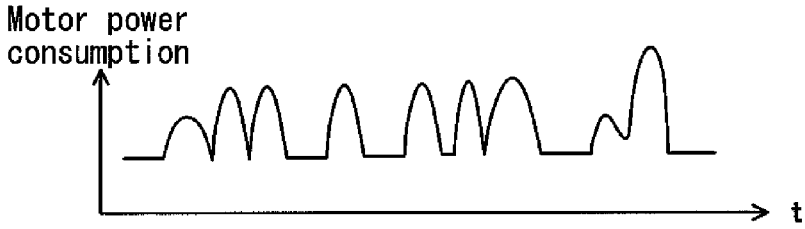

In conventional arrangements, whenever an external force acts on the outboard engine main body as shown in FIG. 14A and the actual pivot angle changes as shown in FIG. 14B, the system reacts to bring the actual pivot angle of the outboard engine main body back to the original setting and this leads to endless consumption of electric power by the electric motor as shown in FIG. 14C.

Figure 14D:
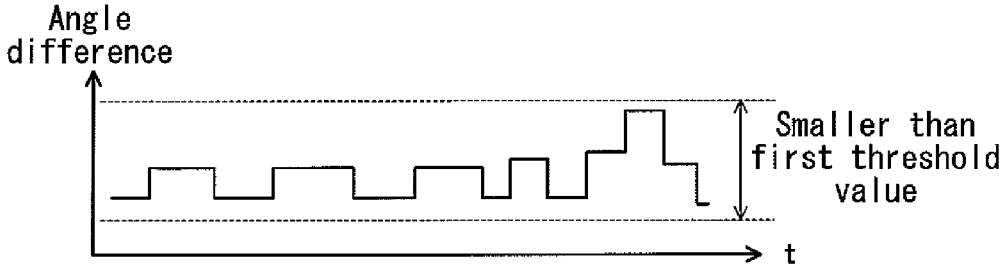
Figure 14E:
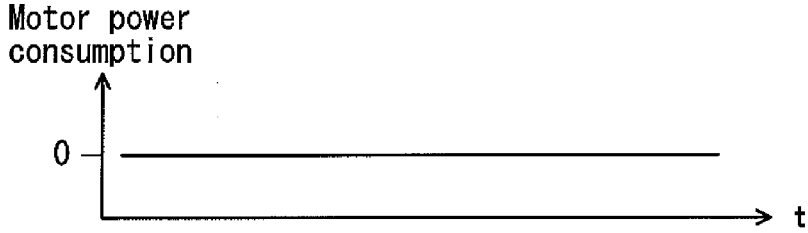

However, according to the boat propelling system 10, the external force acting on the outboard engine main body 28 will not trigger a control operation on the movement of the outboard engine main body 28 as shown in FIG. 14D as long as the angle difference between the target pivot angle and the actual pivot angle is smaller than the first threshold value, and therefore the electric motor 62 does not consume electric power as shown in FIG. 14E. In other words, even if an external force acts on the outboard engine main body 28 repeatedly from random directions, the pivot angle on the outboard engine main body 28 is not changed as far as the angle difference stays within a range that will not affect the travel of the boat 1, and therefore it is possible to reduce electric power consumption. The above statement is based on the case where the operation in FIG. 10 is used to determine the necessity/unnecessity for pivot angle maintenance, but the same advantage is obtained in cases where the determination is made by the operation shown in any one of FIG. 11 through FIG. 13.

In the above preferred embodiments, description was made for a case where two of the outboard engines 24, for example, are preferably installed in the boat 1. However, the present invention is not limited by this. The present invention is applicable to cases where only one outboard engine is installed in a boat, or cases where three or more outboard engines are installed.

The present invention being thus far described in terms of preferred embodiments, it should be noted that the preferred embodiments may be varied in many ways within the scope and the spirit of the present invention. The scope of the present invention is only limited by the accompanied claims.

What is claimed is:

1. A boat propelling system for propelling a hull, the boat propelling system comprising:

a propelling system main body;

a bracket section arranged to allow the propelling system main body to pivot in a right-left direction with respect to the hull;

an electric motor provided in the bracket section and arranged to pivot the propelling system main body in the right-left direction;

a transmission mechanism provided in the bracket section and arranged to transmit a driving force of the electric motor to the propelling system main body;

a locking member arranged to transmit the driving force of the electric motor to the transmission mechanism and to lock the transmission mechanism so that the propelling system main body will not be pivoted in the right-left direction by an external force acting on the propelling system main body;

a steering section arranged to steer the propelling system main body;

a steering angle detection section arranged to detect a steering angle of the steering section;

an actual pivot angle detection section arranged to detect an actual pivot angle of the propelling system main body; and a control section arranged and programmed to control the electric motor based on a result of comparison between steering information regarding the steering angle and a threshold value; wherein the steering information includes a steering angle change amount based on a difference between the steering angle detected by the steering angle detection section and a previous steering angle, a target pivot angle based on the steering angle, and an angle difference between the actual pivot angle and the target pivot angle;

the threshold value includes a first threshold value and a second threshold value, both of which exceed zero;

the control section is programmed to set an electric current value of the electric motor to zero if the angle difference between the actual pivot angle and the target pivot angle is smaller than the first threshold value even when the angle difference is not zero and the steering section is determined to not be under operation; and the control section is programmed to not drive the electric motor if the steering angle change amount is smaller than the second threshold value.

2. The boat propelling system according to claim 1, wherein the steering information includes a rotation speed average value of the steering section, the threshold value includes a third threshold value regarding the rotation speed average value, the control section is programmed to control the electric motor based on a result of a comparison between the rotation speed average value and the third threshold value.

3. The boat propelling system according to claim 1, wherein the threshold value includes a fourth threshold value regarding an actual pivot angle change amount, and the control section is programmed to control the electric motor based on a result of comparison between the actual pivot angle change amount and the fourth threshold value.

4. The boat propelling system according to claim 1, further comprising a speed detection section arranged to detect a boat speed which is a speed of the hull, and a setting section arranged to set the first threshold value based on the boat speed.

5. The boat propelling system according to claim 4, wherein the setting section assigns a smaller value to the first threshold value when the boat speed becomes higher.

6. The boat propelling system according to claim 4, wherein the bracket section is arranged to allow the propelling system main body to pivot in an up-down direction with respect to the hull, the boat propelling system further comprising a trim angle detection section arranged to detect a trim angle of the propelling system main body, and the setting section is arranged to set the first threshold value based on the boat speed and the trim angle.

7. A boat propelling system comprising:

a steering section;

a steering angle detection section arranged to detect a steering angle based on an operation of the steering section;

a target pivot angle calculation section arranged to calculate a target pivot angle based on the steering angle;

an actual pivot angle detection section arranged to detect an actual pivot angle;

an angle difference calculation section arranged to calculate an angle difference between the target pivot angle and the actual pivot angle; and a control section programmed to set a target current of an electric motor that pivots the boat propelling system to zero if the angle difference is smaller than a first threshold value that is larger than zero, and a change amount of the steering angle is smaller than a second threshold value that is larger than zero, even when the angle difference is not zero.

8. A pivot angle controlling method for a boat propelling system, the method comprising:

a step of detecting a steering angle based on an operation of a steering section;

a step of calculating a target pivot angle based on the steering angle;

a step of detecting an actual pivot angle;

a step of calculating an angle difference between the target pivot angle and the actual pivot angle; and a step of setting a target current of an electric motor that pivots the boat propelling system to zero if the angle difference is smaller than a first threshold value that is larger than zero, and a change amount of the steering angle is smaller than a second threshold value that is larger than zero, even when the angle difference is not zero.

9. The pivot angle controlling method according to claim 8, further comprising the step of:

a step of calculating the target current based on the angle difference if the angle difference is not smaller than the first threshold value or the change amount of the steering angle is not smaller than the second threshold value.

* * * * *